US009437355B2

(12) United States Patent
Lee et al.

(10) Patent No.: US 9,437,355 B2
(45) Date of Patent: Sep. 6, 2016

(54) AMORPHOUS METAL CORE, INDUCTION APPARATUS USING SAME, AND METHOD FOR MANUFACTURING SAME

(75) Inventors: Chun Geol Lee, Gimpo-si (KR); Dong Wook Jang, Gimpo-si (KR)

(73) Assignee: AMOGREENTECH CO. LTD. (KR)

( * ) Notice: Subject to any disclaimer, the term of this patent is extended or adjusted under 35 U.S.C. 154(b) by 88 days.

(21) Appl. No.: 14/110,234

(22) PCT Filed: Apr. 9, 2012

(86) PCT No.: PCT/KR2012/002669

§ 371 (c)(1),
(2), (4) Date: Oct. 7, 2013

(87) PCT Pub. No.: WO2012/138199

PCT Pub. Date: Oct. 11, 2012

(65) Prior Publication Data

US 2014/0028431 A1 Jan. 30, 2014

(30) Foreign Application Priority Data

Apr. 8, 2011 (KR) ..... 10-2011-0032641

(51) Int. Cl.
*H01F 27/24* (2006.01)
*H01F 17/06* (2006.01)
(Continued)

(52) U.S. Cl.
CPC ..... *H01F 3/02* (2013.01); *H01F 17/04* (2013.01); *H01F 27/245* (2013.01); *H01F 41/0233* (2013.01); *H01F 41/0226* (2013.01); *Y10T 29/49078* (2015.01)

(58) Field of Classification Search
CPC ..... H01F 27/245; H01F 3/10; H01F 37/00; H01F 3/14; H01F 27/25; H01F 3/02; H01F 17/04; H01F 41/0233
USPC ..... 336/212, 200, 198, 178, 134, 210, 216
See application file for complete search history.

(56) References Cited

U.S. PATENT DOCUMENTS 2,372,067 A * 3/1945 Forbes ..... 336/210
3,172,067 A * 3/1965 Gee ..... 336/217
(Continued)

FOREIGN PATENT DOCUMENTS

CA 2364643 6/2002
JP 62008508 1/1987
(Continued)

OTHER PUBLICATIONS

International Search Report—PCT/KR2012/002669 dated Oct. 23, 2012.

*Primary Examiner* — Elvin G Enad
*Assistant Examiner* — Kazi Hossain
(74) *Attorney, Agent, or Firm* — Cantor Colburn LLP

(57) ABSTRACT

Provided are an amorphous metal core that can minimize a core loss in which amorphous thin plate laminates are mutually combined by coupling protrusions and coupling recesses of assembly plates, an induction device, and a method of making the amorphous metal core. The amorphous metal core includes: a number of amorphous metal unit cores that include an amorphous thin plate laminate and a pair of assembly plates that are respectively laminated on the front and rear surfaces of the amorphous thin plate laminate, and are configured to have an I shape, respectively. The induction device includes: an amorphous metal core including a number of amorphous metal unit cores that are formed of an "I" shape, respectively; and at least one coil that is wound on at least one of the amorphous metal unit cores forming the amorphous metal core.

9 Claims, 9 Drawing Sheets

(51) Int. Cl.

| | |
|---|---|
| ***H01F 21/06*** | (2006.01) |
| ***H01F 27/26*** | (2006.01) |
| ***H01F 3/02*** | (2006.01) |
| ***H01F 27/245*** | (2006.01) |
| ***H01F 17/04*** | (2006.01) |
| *H01F 41/02* | (2006.01) |

(56) References Cited

U.S. PATENT DOCUMENTS

| | | | | |
|---|---|---|---|---|
| 3,436,707 | A * | 4/1969 | Andersen et al. | 336/134 |
| 3,676,918 | A * | 7/1972 | Fischer | 29/453 |
| 4,072,873 | A * | 2/1978 | Nottingham | 310/71 |
| 4,939,623 | A * | 7/1990 | Equi et al. | 361/752 |
| 6,784,781 | B1 * | 8/2004 | Collins et al. | 336/212 |
| 2002/0084879 | A1 * | 7/2002 | Weber et al. | 336/200 |
| 2004/0227473 | A1 * | 11/2004 | Shimizu et al. | 318/114 |
| 2005/0258926 | A1 * | 11/2005 | Weger | 336/212 |
| 2006/0066433 | A1 * | 3/2006 | Decristofaro et al. | 336/212 |
| 2008/0024262 | A1 * | 1/2008 | Chang et al. | 336/208 |
| 2008/0252406 | A1 * | 10/2008 | Kitajima et al. | 336/83 |
| 2010/0079230 | A1 * | 4/2010 | Brubaker et al. | 336/196 |

FOREIGN PATENT DOCUMENTS

| | | |
|---|---|---|
| JP | 2000114064 | 4/2000 |
| KR | 20050067222 | 6/2005 |

* cited by examiner

AMORPHOUS METAL CORE, INDUCTION APPARATUS USING SAME, AND METHOD FOR MANUFACTURING SAME

TECHNICAL FIELD

The present invention relates to an amorphous metal core, an induction device using the same, and a method for making the amorphous metal core. More particularly, the present invention relates to an amorphous metal core that may be easily assembled and that may easily adjust an air gap. in which a number of amorphous metal sheets (or thin plates) that may be easily molded and automated are laminated to make amorphous thin plate laminates, and the amorphous thin plate laminates are mutually coupled by using coupling protrusions and coupling recesses that are respectively formed on assembly plates that are provided on the outer sides of the amorphous thin plate laminates, an induction device using the same, and a method for making the amorphous metal core.

In addition, the present invention relates to an amorphous metal core that can minimize a core loss by adding and setting a minimized mechanical stress that does not cause degradation of magnetic properties such as permeability and the core loss in amorphous thin plate laminates, since the amorphous thin plate laminates are mutually coupled by using coupling protrusions and coupling recesses that are respectively formed on assembly plates, and an induction device using the same.

BACKGROUND ART

Induction devices are used in a variety of electronic components such as transformers, choke coils, inductors, or noise suppression components. Most of the induction devices consist of a core including a soft ferromagnetic material and one or more coils surrounding the core. This induction device is optimized depending on the type to operate at a desired frequency from the direct-current (DC) frequency to the GHz frequency.

In particular, the soft magnetic material is selected as the material of the core, depending on a combination of required characteristics, availability of a material in the form that can be effectively manufactured, and required size/cost necessary to be used in a given market.

In general, preferable soft magnetic materials represent characteristics of high saturation induction, high permeability and low core loss, to minimize size and low saturation coercivity of a core, and the silicon steel sheets, ferrite, amorphous metal, etc., are known as the kinds of the soft magnetic materials.

Specifically, the silicon steel sheet materials are cheap and have a high density, but are limited to have a large core loss in high-frequency use. In addition, since the ferrite has a low saturation flux density, and a poor temperature characteristic, it is not suitable for use of high power components such as high-capacity inverters, coil parts of power sources, and distribution transformers.

Meanwhile, the amorphous metal has a constituent atom having a disordered structure similar to the liquid state, and is manufactured by rapid cooling of molten liquid metal to thus represent various characteristics different from the existing crystalline materials, in particular, show excellent soft magnetic properties.

The amorphous metal is largely classified into iron (Fe)-based metal, cobalt (Co)-based metal, etc., depending on the main ingredient thereof. The Fe-based amorphous metal has a high saturation flux density and a small core loss when compared to those of the silicon steel sheet. Accordingly, the Fe-based amorphous metal is used in a large capacity pole transformer or in a high frequency large magnetic core. The Co-based amorphous metal has a high permeability, and a core loss and coercivity, and thus is used as a high frequency small magnetic core.

Moreover, the amorphous metal has a small core loss and a small eddy current loss when compared to other soft magnetic materials, and thus has been highlighted as the soft magnetic material for magnetic cores on behalf of silicon steel sheets or ferrite. The amorphous metal is excellent in view of high-efficiency, high frequency characteristics due to eddy current losses such as large electrical specific resistivity, noise suppression characteristics by high permeability and high saturation flux density, DC bias characteristics, and responsiveness required for miniaturization.

Products with low core loss characteristics are choke cores, high-frequency transformers for use in inverters, distribution transformers, various reactors, etc. Products using high permeability characteristics are pulse transformers, step-up transformers, audio transformers, current transformers, noise filters, etc. In this case, magnetic cores are classified into a relatively small-capacity gap type toroidal shape core and a relatively large-capacity rectangular shape cut core.

The amorphous metal is supplied as a thin continuous ribbon having a generally uniform ribbon width. However, since the amorphous metal is a very mild material, it is not easy to cut or mold the amorphous metal. If the amorphous metal is annealed to ensure peak magnetic properties, amorphous metal ribbons show noticeably great brittleness. The noticeably great brittleness makes it difficult to use conventional methods and causes costs to rise up to form bulk amorphous magnetic members.

The amorphous metal forming amorphous magnetic cores represents superior magnetic properties to other ferromagnetic materials, but has the difficulty in processing materials due to the above-described physical characteristics. In other words, the manufacturing tools may cause excessive wear at the time of performing a cutting process of forming a gap that gives unique magnetic properties in the conventional amorphous toroidal core or amorphous cut core.

In addition, in the case of the amorphous cut core, the amorphous ribbon is wound and impregnated and then fixed with a glue, to then undergo a cutting process for forming a gap, and a process of polishing a cut surface. This causes a problem of destructing insulation of the cut surface to thus increase the eddy current loss.

Meanwhile, the Korean Patent Laid-open Publication No. 2005-67222 proposed a method of cutting an amorphous metal strip material to form a number of flat thin plates, respectively, to then laminating and aligning the flat thin plates in order to form bulk amorphous metal magnetic components (that is, thin plate laminates) having a three-dimensional shape, and annealing the thin plate laminates in order to improve the magnetic properties, to then bond the thin plate laminates with an adhesive.

The thin plate laminates are formed of only a number of amorphous metal thin plates in the Korean Patent Laid-open Publication No. 2005-67222, and thus gaps and parallel states of the respective thin plate laminates with respect to the adjoining thin plate laminates are adjusted by using a retaining member to thus be mechanically assembled, for example, when the thin plate laminates are joined (or combined) with each other, to thus form a magnetic core (or a magnetic circuit) of a rectangle with a combination of an 'E-I type, a 'C-I' type, or four I types.

Adhesives are used or bands and housings are proposed as the retaining member, in order to prevent a high stress that will result in the degradation of the magnetic properties such as permeability and core loss from being added to the components.

The above-described Korean Patent Laid-open Publication No. 2005-67222 proposed a method of using a lithographic etching process in thin plates of complex shapes and using a stamping process in thin plates of large and simple shapes when cutting amorphous metal strip materials.

However, the lithographic etching process results in an increase in a machining cost to thus make it difficult to be applied to large-scale thin plates. In the case that the complex and large-scale thin plates such as E-, U-, and C-type thin plates employ a stamping machining method, although a punch and a die are configured by using a material having higher hardness than that of the amorphous metal, the wear of the punch and the die is caused in a mass-production process of machining a large number of thin plates, to thereby fail to ensure durability, and result in a rise in machining costs. Thus, a method of sufficiently ensuring the durability of machining equipment is required.

In addition, when the thin plate laminates are joined (or combined) to thus form (or temporarily assemble) a magnetic core (that is, a magnetic circuit) of a rectangle combined with four I shapes, while inserting a spacer in an air gap, and then the magnetic core (or the magnetic circuit) is fixed by a retaining unit such as a band, the two I-type thin plate laminates facing each other are required to be temporarily assembled while maintaining a state parallel to a pre-set interval. However, a structure or method of implementing the required two I-shaped thin plate laminates while maintaining high productivity has not been presented.

Moreover, even if the magnetic core (or the magnetic circuit) such as 'E-I' type and 'C-I' type is formed (or temporarily assembled) by inserting a spacer into an air gap, a structure of keeping the temporarily assembled state while ensuring a precise air gap similarly to the above-described case is not presented at all.

In addition, when a plurality of thin plate laminates are combined so as to form a magnetic circuit, a mechanical stress is added to the amorphous thin plate laminates, to thus cause a problem of increasing a core loss.

DISCLOSURE

Technical Problem

To solve the above problems or defects, it is an object of the present invention to provide an amorphous metal core including an I type amorphous thin plate laminate that is formed by laminating a number of rectangular amorphous metal thin plates in which the amorphous metal thin plates are formed by only a slitting and linear cutting process or a punching process so as to ensure sufficient durability of a molding device and ease of automation of a molding process, an induction device using the same, and a method of manufacturing the amorphous metal core.

In addition, it is another object of the present invention to provide an amorphous metal core that may be easily assembled by using coupling protrusions and coupling recesses that are respectively formed on assembly plates of yokes and legs, and that may be maintained into an assembled state although an air gap is given and a spacer is inserted into the amorphous metal core, and an induction device using the same.

Furthermore, it is still another object of the present invention to provide an amorphous metal core that may adjust a precise air gap by using lengths of coupling protrusions and depths of coupling recesses that are respectively formed on assembly plates of yokes and legs, and an induction device using the same.

In addition, it is yet another object of the present invention to provide an amorphous metal core that can minimize a core loss by adding and setting a minimized mechanical stress that does not cause degradation of magnetic properties such as permeability and the core loss in amorphous thin plate laminates, since the amorphous thin plate laminates are mutually coupled by using coupling protrusions and coupling recesses that are respectively formed on assembly plates of yokes and legs, and an induction device using the same.

Technical Solution

To accomplish the above and other objects of the present invention, according to an aspect of the present invention, there is provided an amorphous metal core comprising: an amorphous thin plate laminate that is formed by laminating a number of amorphous ribbons; and a pair of assembly plates that cover the front and rear surfaces of the amorphous thin plate laminate. In this case, a number of amorphous thin plate laminates are impregnated with a glue (or an adhesive) so as to be coupled to each other.

The amorphous thin plate laminate is preferably a Fe-based or Co-based amorphous magnetic alloy, and in this case, the Fe-based amorphous magnetic alloy is preferably any one of Fe—Si—B, Fe—Si—Al, Fe—Hf—C, Fe—Cu—Nb—Si—B, Fe—Si—N, and Fe—Si—BC, or the Co-based amorphous magnetic alloy is preferably Co—Fe—Si—B or Co—Fe—Ni—Si—B.

In addition, the amorphous thin plate laminate is also possible to be an alloy having a composition which is defined as the $Fe_{80}B_{11}Si_3$.

In addition, the above and other objects of the present invention can be accomplished by providing an amorphous metal core comprising: first and second yokes each including an amorphous thin plate laminate; and assembly plates that are respectively formed on front and rear surfaces of the amorphous thin plate laminate, and that are arranged in parallel to each other and spaced by an interval from each other; first and second legs each including an amorphous thin plate laminate; and assembly plates that are respectively formed on front and rear surfaces of the amorphous thin plate laminate, and that are arranged in parallel to each other between the first and second yokes, wherein the assembly plates of the first and second yokes are interconnected with the assembly plates of the first and second legs through coupling protrusions and coupling recesses that are respectively formed on the first and second yokes and the first and second legs.

In this case, the first and second yokes and the first and second legs are joined together thereby preferably forming a rectangular shape.

The lengths of the coupling protrusions and the depths of the coupling recesses formed on the assembly plates are adjusted, to thus adjust an interval of the air gap that is formed between the first and second yokes and the first and second legs.

In addition, it is also possible that the coupling protrusions are formed on the assembly plates of the first and second yokes, respectively, and the coupling recesses are formed on the assembly plates of the first and second legs, respectively, in correspondence to the coupling protrusions.

In addition, it is preferable that the coupling recesses are formed on the assembly plates of the first and second yokes, respectively, and the coupling protrusions are formed on the assembly plates of the first and second legs, respectively, in correspondence to the coupling recesses.

In addition, the above and other objects of the present invention can be accomplished by providing an induction device comprising: an amorphous metal core; first and second laminated coils that are wound on first and second legs of the amorphous metal core, respectively; a pair of terminals that are connected to the ends of the first and second laminated coils, respectively; and an upper cover and a lower cover that surround the amorphous metal core.

The upper cover and the lower cover can be connected to each other by a pair of tightening bolts.

In addition, the above and other objects of the present invention can be accomplished by providing a method of making an amorphous thin plate laminate for use in an amorphous metal core, the method comprising the steps of: forming a number of rectangular ribbons by cutting an amorphous metal thin plate at an identical interval; thermally treating the ribbons by laminating the ribbons in a heat treatment jig; assembling the heat treated ribbons in the jig, and then impregnating the assembled ribbons into a prepared adhesive, to thus bond a number of the ribbons in a laminated state; and curing the bonded ribbons.

The heat treatment is performed in the air, wherein the heat treatment time includes a temperature rise time of 1 hour and a temperature retaining time of 7 hours and the heat treatment temperature is set in the range of 380° C. to 450° C.

The adhesive is preferably any one of an epoxy group resin, acrylic group resin, silicone, and varnish.

Advantageous Effects

As described above, according to the present invention, an amorphous metal core includes an I type amorphous thin plate laminate that is formed by laminating a number of rectangular amorphous metal thin plates in which the amorphous metal thin plates are formed by only a slitting and linear cutting process or a punching process so as to ensure sufficient durability of a molding device and ease of automation of a molding process.

In addition, according to the present invention, an amorphous metal core may be easily temporarily assembled by simply connecting coupling protrusions and coupling recesses that are respectively formed on assembly plates of yokes and legs, and may be maintained into a temporarily assembled state although an air gap is given and a spacer is inserted into the amorphous metal core, to thereby provide high assembly productivity and ease of assembly automation.

Furthermore, according to the present invention, a precise air gap may be adjusted by using lengths of coupling protrusions and depths of coupling recesses that are respectively formed on assembly plates of yokes and legs.

In addition, according to the present invention, an amorphous metal core can minimize a core loss by adding and setting a minimized mechanical stress that does not cause degradation of magnetic properties such as permeability and the core loss in amorphous thin plate laminates, since the amorphous thin plate laminates are mutually coupled by using coupling protrusions and coupling recesses that are respectively formed on assembly plates of yokes and legs.

In other words, according to the present invention, a pair of assembly plates that are respectively formed on the upper/lower portions of an amorphous thin plate laminate, are formed of a material of a non-magnetic metal such as Steel Use Stainless (SUS), a crystalline magnetic material such as silicon steel, or a synthetic resin, and an amorphous metal core is assembled by using coupling protrusions and coupling recesses that are respectively formed on the assembly plates, to thereby minimize an addition of a mechanical stress applied to the amorphous thin plate laminate and to thus maximize magnetic properties of the core.

Moreover, in the case of an amorphous cut core, insulation is destroyed according to cutting for forming a gap and polishing a cut surface, to thereby cause a problem of increasing an eddy current loss. However, according to the present invention, a number of rectangular amorphous metal thin plates are laminated to then undergo an adhesive impregnating process, and an interval of an air gap is automatically set by assembly plates when amorphous metal unit cores are assembled, to thereby prevent a problem of increasing an eddy current loss from being caused.

BEST MODE

Figure 1:
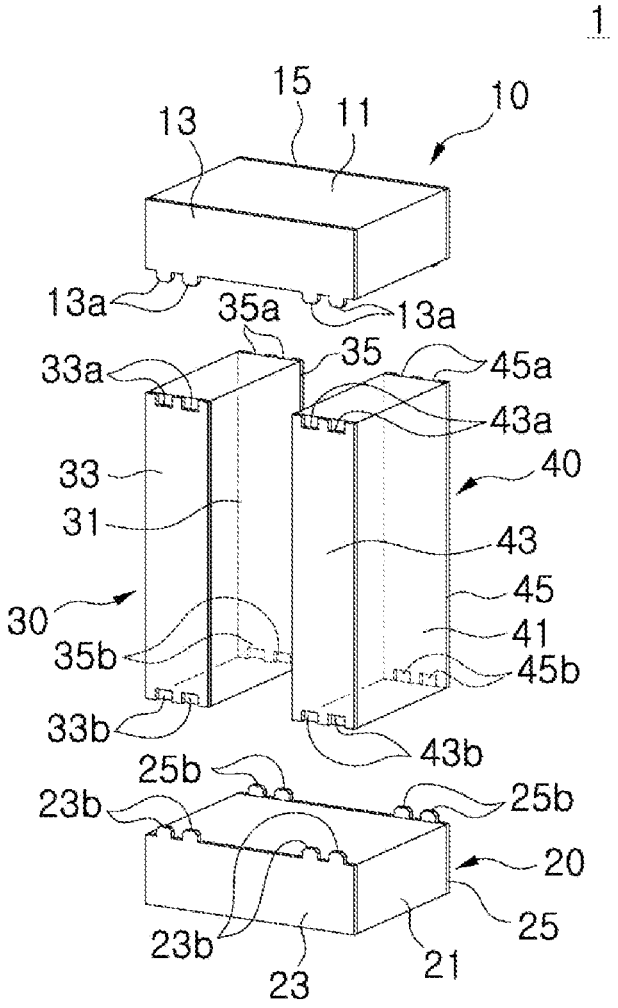
FIG. 1 is an exploded perspective view of an amorphous metal core according to a first embodiment of the present invention.

Hereinafter, a structure of an amorphous metal core, a method of making the amorphous metal core, and an induction device using the amorphous metal core, according to an embodiment of the present invention will be described in detail with reference to the accompanying drawings.

The amorphous metal core according to the present invention is provided with a number of amorphous metal unit cores, each having a bar type formed of an "I" shape, to form a magnetic circuit which includes at least one air gap and at least one spacer.

The amorphous metal unit core includes: an amorphous thin plate laminate that is formed by laminating a number of rectangular amorphous metal thin plates that are obtained by slitting and cutting a wide ribbon made of an amorphous magnetic alloy with excellent soft magnetic properties in a desired width and length; and a pair of rectangular assembly plates that are made of a non-magnetic metal, a crystalline magnetic material, or a synthetic resin, and that are laminated on the front and rear surfaces of the amorphous thin plate laminate corresponding to the amorphous thin plate laminate.

These amorphous metal unit cores are formed of an "I" shape, respectively, and are used as legs on the outer portions of which coils are wound, or yokes that interconnect the legs to form a magnetic circuit. In this case, the amorphous metal core are provided with legs and yokes as needed to form a magnetic circuit, in which the legs and yokes are formed of at least one amorphous metal unit core, respectively. In addition, the amorphous metal unit cores are connected in series or in parallel to each other to include at least one air gap and at least one spacer.

In other words, the amorphous metal unit cores are changed in nothing but lengths according to usage of the magnetic circuit and position where the magnetic circuit is used, and have an identical structure. Thus, the amorphous metal core according to the present invention is provided with a number of "I" shapes amorphous metal unit cores whose lengths are identical with or different from each other.

The amorphous metal core that will be described below with reference to drawings is nothing but an example, and can be applied to various magnetic circuits including at least one air gap and at least one spacer.

Referring to FIGS. 1 to 4, an amorphous metal core 1 according to the first embodiment of the present invention includes first and second yokes 10 and 20 that are placed in parallel to each other at the upper and lower portions, and first and second legs 30 and 40 that are coupled at right angles on both ends of the first and second yokes 10 and 20, respectively, and that are placed in parallel to each other.

In this case, the amorphous metal core 1 is configured to have the first and second yokes 10 and 20 coupled with the first and second legs 30 and 40 to form a rectangular shape, and the latter assembled with the former at right angles.

The first and second yokes 10 and 20 are formed of an identical structure with each other. In other words, a pair of yokes 10 and 20 include amorphous thin plate laminates 11 and 21 made of an "I" shape and formed of a rectangular parallelepiped, respectively. A process of manufacturing the amorphous thin plate laminates 11 and 21 of the first and second yokes 10 and 20 and the amorphous thin plate laminates 31 and 41 of the first and second legs 30 and 40 will be described after configuration of the amorphous metal core 1 will have been described.

In addition, the first and second yokes 10 and 20 are respectively configured so that the rectangular assembly plates 13 and 15; and 23 and 25 are attached on and fixed to the front and rear surfaces of the respective amorphous thin plate laminates 11 and 21, by means of a predetermined adhesive, in correspondence to the respective amorphous thin plate laminates 11 and 21. In this case, the assembly plates 13 and 15; and 23 and 25 are preferably of widths corresponding to the widths of the first and second yokes 10 and 20, respectively.

The assembly plates 13 and 15; and 23 and 25 are preferably made, for example, of a non-magnetic metal such as SUS, a crystalline magnetic material such as silicon steel, or synthetic resin, etc.

The assembly plates 13 and 15 that are respectively attached to the front and rear surfaces of the first yoke 10 are configured to have a pair of coupling protrusions 13*a* and 15*a* that are respectively symmetrically extended at intervals along the bottom ends of the assembly plates 13 and 15. In addition, the assembly plates 23 and 25 that are respectively attached to the front and rear surfaces of the second yoke 20 are configured to have a pair of coupling protrusions 23*a* and 25*a* that are respectively symmetrically extended at intervals along the top ends of the assembly plates 23 and 25. In other words, the coupling protrusions 13*a* and 15*a*; 23*b* and 25*b* are protrudingly formed toward the first and second legs 30 and 40 that are disposed between the first and second yokes 10 and 20.

Like the first and second yokes 10 and 20, the first and second legs 30 and 40 include amorphous thin plate laminates 31 and 41 made of an "I" shape and formed of a rectangular parallelepiped, respectively. The rectangular assembly plates 33 and 35; and 43 and 45 are attached on and fixed to the front and rear surfaces of the respective amorphous thin plate laminates 31 and 41, in correspondence to the respective amorphous thin plate laminates 31 and 41. In this case, the assembly plates 33 and 35; and 43 and 45 have widths corresponding to the widths of the first and second legs 30 and 40, respectively.

In addition, the assembly plates 33 and 35; 43 and 45 are configured to have coupling recesses 33*a* and 35*a*; 43*a* and 45*a* into which the coupling protrusions 13*a* and 15*a* of the assembly plates 13 and 15 of the first yoke 10 are respectively inserted along the top ends of the assembly plates 33 and 35; 43 and 45, and are configured to have coupling recesses 33*b* and 35*b*; 43*b* and 45*b* into which the coupling protrusions 23*b* and 23*b* of the assembly plates 23 and 25 of the second yoke 20 are respectively inserted along the bottom ends of the assembly plates 33 and 35; 43 and 45.

The first and second yokes 10 and 20 and the first and second legs 30 and 40 facilitate to combine with each other through the coupling protrusions 13*a* and 15*a*; 23*b* and 25*b*, and the coupling recesses 33*a*, 33*b*, 35*a*, and 35*b*; 43*a*, 43*b*, 45*a*, and 45*b*.

The coupling protrusions 13*a* and 15*a*; 23*b* and 25*b*, and the coupling recesses 33*a*, 33*b*, 35*a*, and 35*b*; 43*a*, 43*b*, 45*a*, and 45*b* are configured to form a coupling unit that combine the first and second yokes 10 and 20 and the first and second legs 30 and 40 so as to be mutually separated from each other.

The assembly plates 13 and 15; 23 and 25; 33 and 35; and 43 and 45 protect the amorphous thin plate laminates 11, 21, 31, and 41 and combine the first and second yokes 10 and 20 and the first and second legs 30 and 40 with the above-described coupling unit such as the coupling protrusions 13*a* and 15*a*; 23*b* and 25*b*, and the coupling recesses 33*a*, 33*b*, 35*a*, and 35*b*; 43*a*, 43*b*, 45*a*, and 45*b* so as to be mutually separated from each other. The first and second yokes 10 and 20 and the first and second legs 30 and 40 are combined with each other, in a manner that a minimized mechanical stress is added to the amorphous thin plate laminates 11, 21, 31, and 41.

In addition, as required, the coupling protrusions 13*a* and 15*a*; 23*b* and 25*b*, and the coupling recesses 33*a*, 33*b*, 35*a*, and 35*b*; 43*a*, 43*b*, 45*a*, and 45*b* that form the coupling unit may be configured to further include at least one pair of snap coupling small-scale recesses formed on the inner circumferential surfaces of the coupling recesses 33*a*, 33*b*, 35*a*, and 35*b*; 43*a*, 43*b*, 45*a*, and 45*b* in correspondence to the opposite coupling protrusions 13*a* and 15*a*; 23*b* and 25*b*, and to further include at least one pair of snap coupling small-scale protrusions formed on the outer circumferential surfaces of both sides of the coupling protrusions 13*a* and 15*a*; 23*b* and 25*b*, when the coupling protrusions 13*a* and 15*a*; 23*b* and 25*b*, and the coupling recesses 33*a*, 33*b*, 35*a*, and 35*b*; 43*a*, 43*b*, 45*a*, and 45*b* are mutually compressively coupled, or mutually snap-coupled.

The structure of the coupling unit and the compression or snap coupling structure may be modified into different shapes, and may be implemented by adopting any known structures.

As a result, a coupling force or cohesion is provided between the first and second yokes 10 and 20 and the first and second legs 30 and 40, so as to persistently maintain the mutually coupled state.

Figure 7:
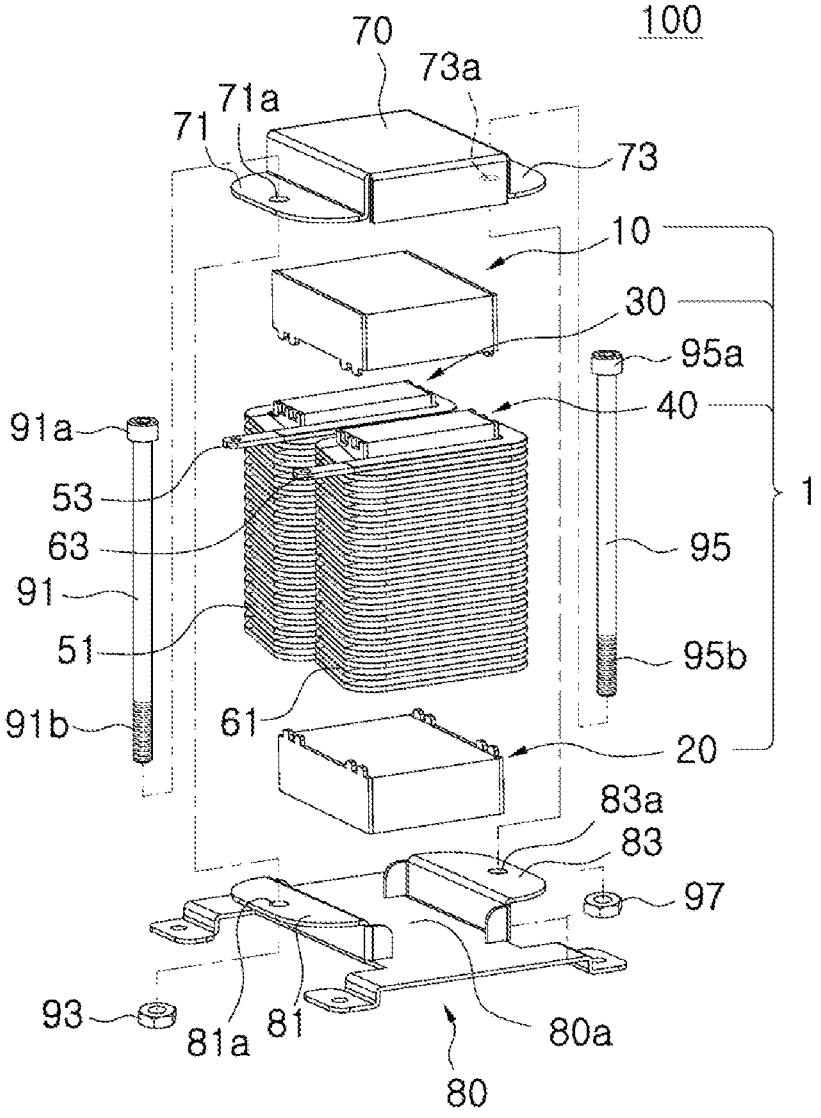
FIGS. 7 and 8 are an exploded perspective view and an assembly perspective view of an induction device according to the first embodiment of the present invention, respectively.

Meanwhile, the first and second yokes 10 and 20 and the first and second legs 30 and 40 that are assembled between upper and lower covers 70 and 80 to be described later with reference to FIG. 7, are mutually coupled by using the assembly plates 13 and 15; 23 and 25; 33 and 35; and 43 and 45, instead of directly assembling the amorphous thin plate laminates 11, 21, 31, and 41. Accordingly, a minimized mechanical stress is added to the amorphous thin plate laminates 11, 21, 31, and 41, to thus suppress a core loss to a minimum.

Figure 9:
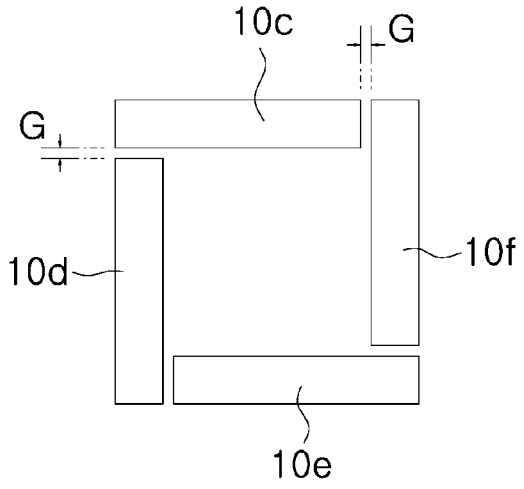
FIG. 9 is a schematic plan view showing a square amorphous metal core that is formed by assembling four identical I-shaped amorphous metal unit cores according to a third embodiment of the present invention.
Figure 10:
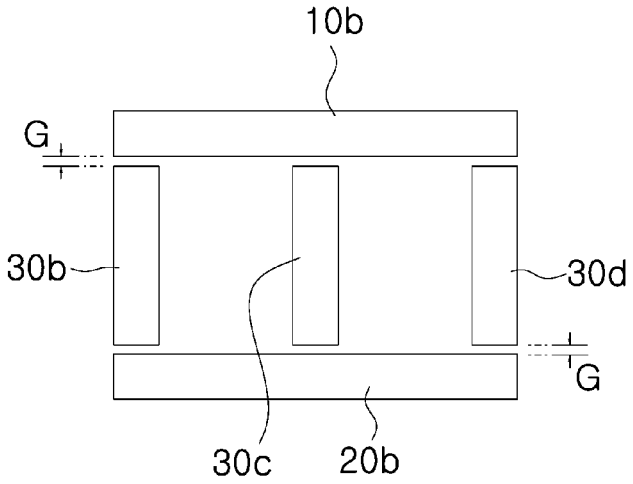
FIG. 10 is a schematic plan view showing an amorphous metal core for a three-phase transformer including two yokes and three legs according to a fourth embodiment of the present invention.

Meanwhile, the amorphous metal core 1 may include at least one air gap at the time of forming a magnetic circuit including an air gap G and a spacer, as shown in FIGS. 9 and 10. In this case, an air gap G may be precisely formed in an interval (that is, a magnetic gap) between the first and second yokes 10 and 20 and the first and second legs 30 and 40 by adjusting the lengths of the coupling protrusions 13*a* and 15*a*; 23*b* and 25*b*, and the depths of the coupling recesses 33*a*, 33*b*, 35*a*, and 35*b*; 43*a*, 43*b*, 45*a*, and 45*b*. In this case, in order to reduce the eddy current loss by taking into account characteristics that inductance becomes smaller as the interval of the air gap G becomes farther, the interval between the first and second yokes 10 and 20 and the first and second legs 30 and 40 may be optimized by pre-setting the lengths of the coupling protrusions 13*a* and 15*a*; 23*b* and 25*b*, and the depths of the coupling recesses 33*a*. 33*b*, 35*a*, and 35*b*; 43*a*, 43*b*, 45*a*, and 45*b*.

In addition, if the interval between the first and second yokes 10 and 20 and the first and second legs 30 and 40 is optimized by pre-setting the lengths of the coupling protrusions 13*a* and 15*a*; 23*b* and 25*b*, and the depths of the coupling recesses 33*a*, 33*b*, 35*a*, and 35*b*; 43*a*, 43*b*, 45*a*, and 45*b* when a magnetic circuit including an air gap and a spacer is formed, the amorphous thin plate laminates 11, 21, 31, and 41 may be maintained in a temporarily assembled state although an air gap is given and a spacer is inserted into the interval between the first and second yokes 10 and 20 and the first and second legs 30 and 40 as described below, to thus be finally fixed by using bands or the upper and lower covers 70 and 80 shown in FIG. 7 while maintaining a precisely assembled state.

In the above-described embodiments, each pair of the coupling protrusions 13*a* and 15*a*; 23*b* and 25*b*, and the coupling recesses 33*a*, 33*b*, 35*a*, and 35*b*; 43*a*. 43*b*, 45*a*, and 45*b* are formed in the first and second yokes 10 and 20 and the first and second legs 30 and 40, respectively, but the first and second yokes 10 and 20 and the first and second legs 30 and 40 may be coupled even with at least one coupling protrusion and at least one coupling recess. As needed, a coupling force may be increased by providing three coupling protrusions and three coupling recesses, respectively.

In addition, a coupling protrusion and a coupling recess may be provided for the first and second yokes 10 and 20, respectively, and a coupling protrusion and a coupling recess may be respectively provided for the first and second legs 30 and 40 that are coupled with the first and second yokes 10 and 20, respectively.

Meanwhile, the amorphous thin plate laminates 11, 21, 31, and 41 are made of an available amorphous magnetic alloy, but is not particularly limited thereto. However, Fe-based or Co-based alloys are preferred when considering the cost and the magnetic core characteristics. Specifically, as an available amorphous magnetic alloys, the Fe-based amorphous magnetic alloy is preferably any one of Fe—Si—B, Fe—Si—Al, Fe—Hf—C, Fe—Cu—Nb—Si—B, Fe—Si—N, and Fe—Si—BC, and the Co-based amorphous magnetic alloy is preferably Co—Fe—Si—B or Co—Fe—Ni—Si—B. More specifically, the amorphous thin plate laminate is also possible to be an alloy having a composition which is defined as the $Fe_{80}B_{11}Si_3$.

Figure 5:
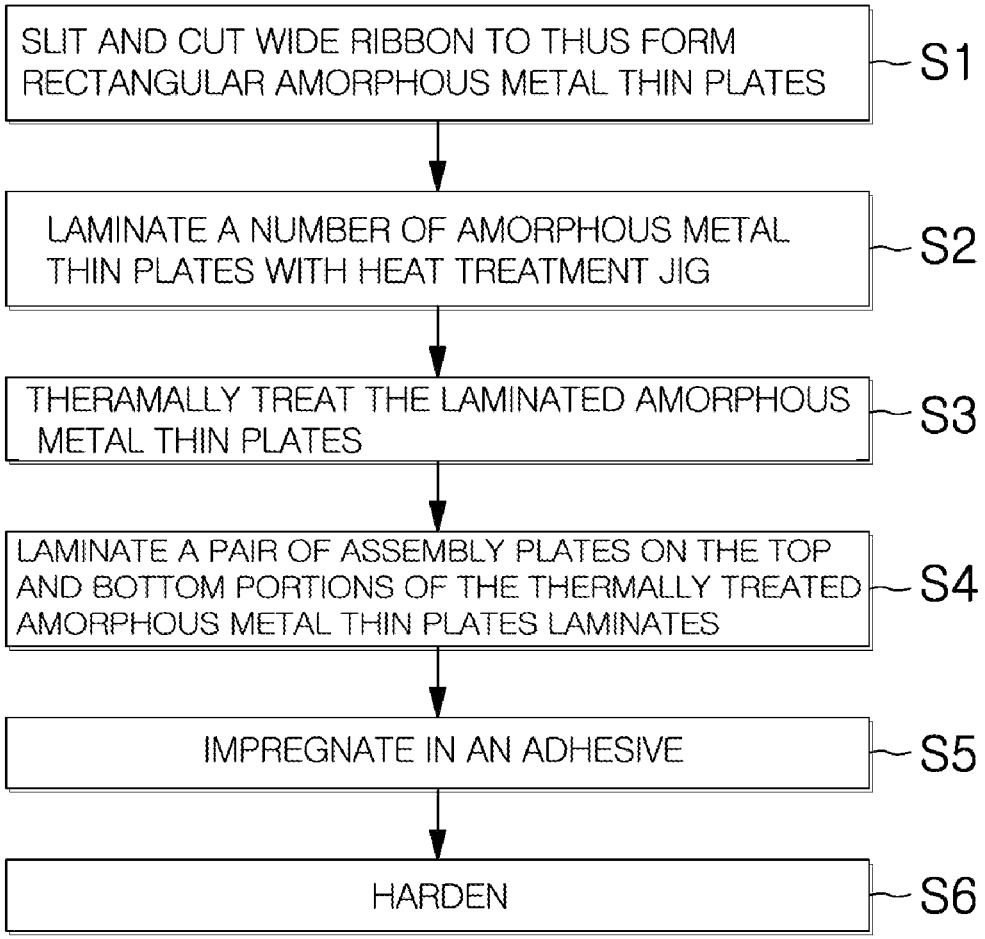
FIG. 5 is a flowchart view of a manufacturing process of an amorphous laminate of an amorphous metal core according to the first embodiment of the present invention.

A process of manufacturing the amorphous thin plate laminate 11, 21, 31, or 41 will be described with reference to FIG. 5.

First, a plurality of rectangular amorphous metal thin plates by performing a slitting and cutting process of a wide ribbon made of amorphous metal (S1). In other words, the rectangular and I-shaped amorphous metal thin plates are formed by slitting an amorphous metal ribbon that is provided as a thin and continuous wide ribbon with a uniform thickness into a desired width, and then straightly cutting the wide ribbon in the same length as that of the yoke or leg, to thus form a number of amorphous metal thin plates 11*a* and 31*a* (see FIGS. 2 and 3).

Then, a plurality of the molded amorphous metal thin plates 11*a* and 31*a* are laminated with a heat treatment jig (S2), and the amorphous metal thin plates 11*a* and 31*a* that are laminated in order to improve the magnetic properties are thermally treated under the magnetic field atmosphere (S3).

The heat treatment is executed in a manner that a number of amorphous metal plates 11*a* and 31*a* have magnetic core characteristics, for example, under the heat treatment conditions including a temperature rise time of 1 hour and a temperature retaining time of 7 hours in the air and the heat treatment temperature set in the range of 380° C. to 450° C. The heat treatment is executed to obtain a desired permeability. In particular, when permeability becomes higher, the core loss is further reduced, the saturation flux density (Bs) becomes greater, the coercive force (Hc) becomes smaller, and an aspect ratio is increased.

Then, a number of the amorphous metal plates 11*a* and 31*a* that have been thermally treated are assembled in a jig to form a laminate (S4), and are impregnated into a prepared adhesive (S5), to thus make a number of amorphous metal plates 11*a* and 31*a* bonded in a laminated state, and to then be made into the amorphous thin plate laminates 11, 21, 31, and 41.

In this case, the adhesive is preferably any one of an epoxy group resin, acrylic group resin, silicone, and varnish. For example, a number of amorphous metal plates 11*a* and 31*a* are impregnated in an epoxy resin under the vacuum condition so that the epoxy resin is penetrated between the amorphous metal plates 11*a* and 31*a* to then be hardened. Meanwhile, since epoxy group adhesives are burnt at 400° C., for example, it is desirable that the amorphous metal plates 11*a* and 31*a* are thermally treated prior to an adhesive impregnation process, but the adhesive impregnation process may be carried out before heat treatment depending on the type of an adhesive.

Figure 2:
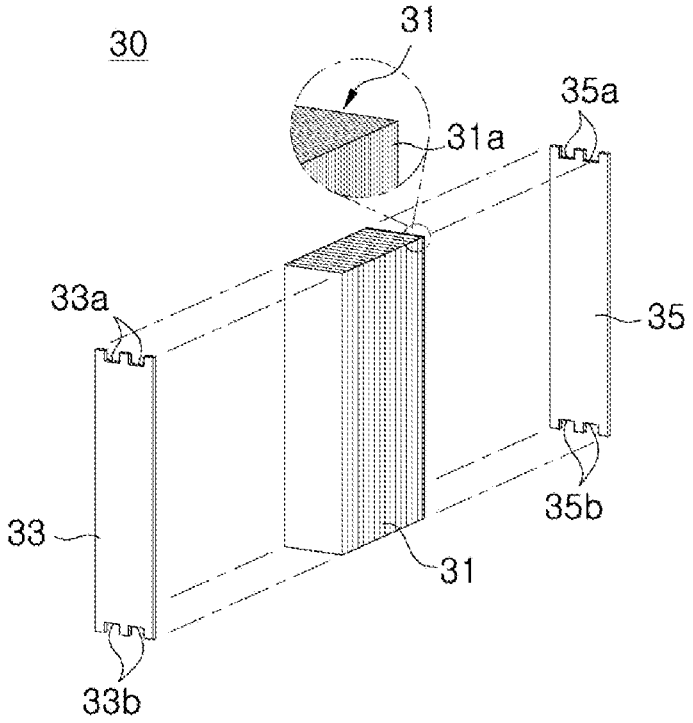
FIGS. 2 and 3 are an exploded perspective view of the amorphous metal core that forms one of the legs and one of the yokes shown in FIG. 1, respectively.
Figure 3:
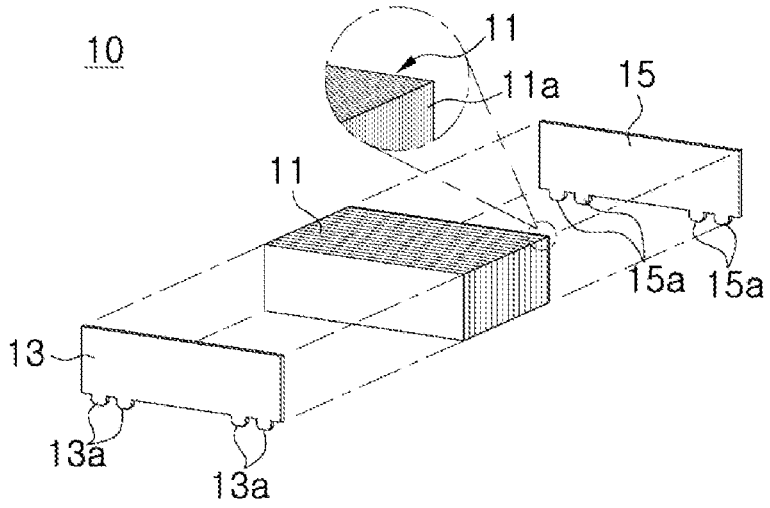
Figure 4:
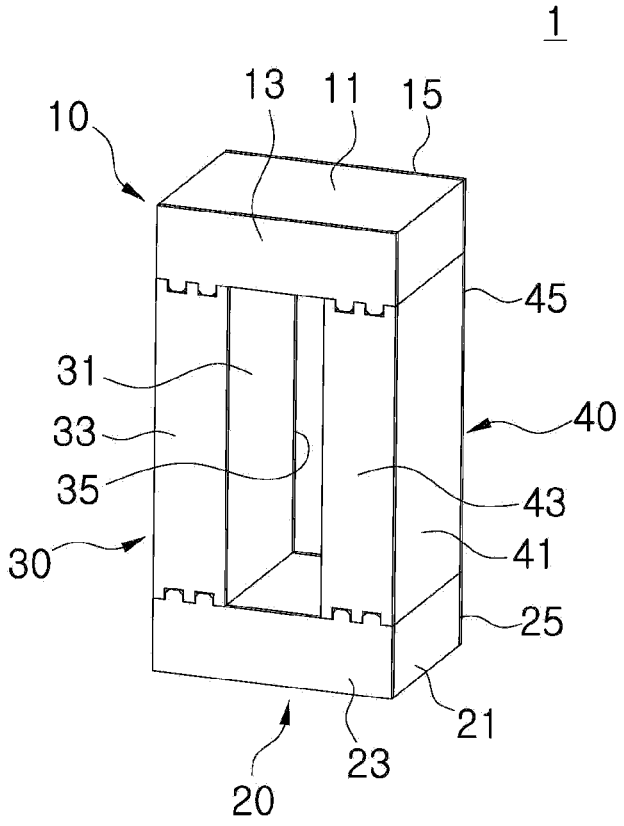
FIG. 4 is an assembly perspective view of an amorphous metal core according to the first embodiment of the present invention.

In this case, when the number of the amorphous metal plates 11*a* and 31*a* are laminated and impregnated with an adhesive, the adhesive impregnation process is carried out at a state where the assembly plates 13 and 15; 33 and 35 are respectively combined on both sides of the amorphous thin plate laminates 11 and 31 as shown in FIGS. 2 and 3, to thus preferably integrate the assembly plates 13 and 15; 33 and 35 on both sides of the amorphous thin plate laminates 11 and 31, respectively, as shown in FIG. 1.

After the amorphous thin plate laminates 11, 21, 31, and 41 have been impregnated in the adhesive, the amorphous thin plate laminates 11, 21, 31, and 41 are hardened (S6), to then undergo measurement and inspection on whether or not the amorphous thin plate laminates 11, 21, 31, and 41 have been produced in accordance with the standards.

Meanwhile, the amorphous metal core 1 may be configured to have the coupling protrusions 13*a* and 15*a*; 23*b* and 25*b*, and the coupling recesses 33*a*, 33*b*, 35*a*, and 35*b*; 43*a*, 43*b*, 45*a*, and 45*b* of the respective assembly plates, so that positions of the coupling protrusions are exchanged with those of the coupling recesses.

Figure 6:
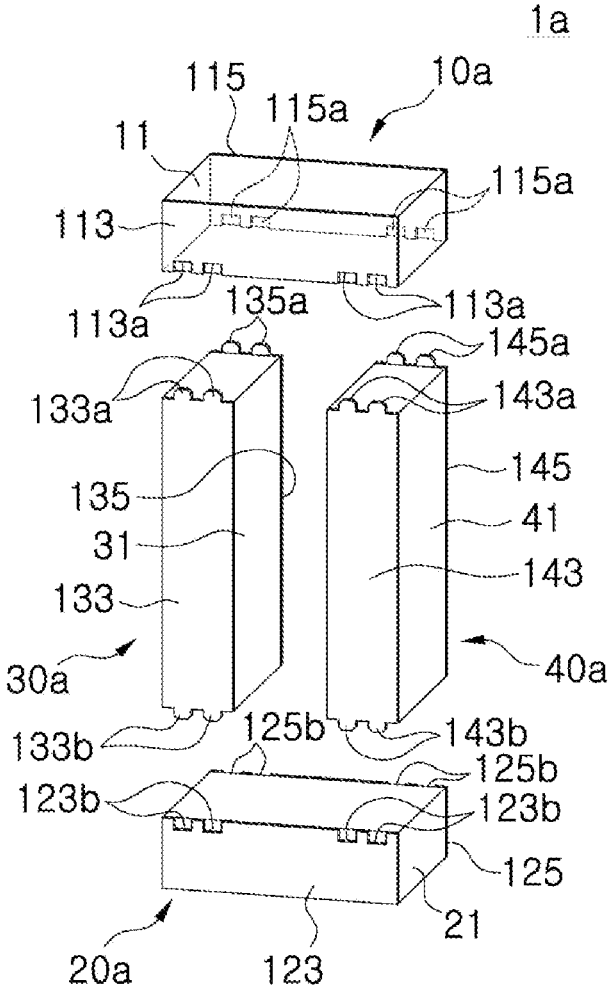
FIG. 6 is an exploded perspective view of an amorphous metal core that indicates the status where positions of coupling protrusions and coupling recesses of assembly plates that are combined with each amorphous metal core shown in FIG. 1 are changed according to a second embodiment of the present invention.

In other words, the amorphous metal core 1*a* shown in FIG. 6 according to a second embodiment of the present invention, is configured to form coupling recesses 113*a* and 115*a*; and 123*b* and 125*b* on assembly plates 113 and 115; and 123 and 125 that are attached and fixed to the front and rear surfaces of first and second yokes 10*a* and 20*a*, respectively, and to form coupling protrusions 133*a* and 133*b*, 135*a* and 135*b*; 143*a*, 143*b*, 145*a* and 145*b* of respective assembly plates 133 and 135; and 143 and 145 that are attached and fixed to the front and rear surfaces of first and second legs 30*a* and 40*a*, respectively, in correspondence to the respective coupling recesses 113*a* and 115*a*; and 123*b* and 125*b*.

Also, although not shown in the drawings, unlike the case shown in FIG. 6, the coupling protrusions and the coupling recesses that are formed in the assembly plates may be formed in the respective assembly plates that are fixed to the front and rear surfaces of a pair of legs, and may be formed in the respective assembly plates that are fixed to the front and rear surfaces of a pair of yokes.

As described above, the amorphous metal unit cores that are formed by making the assembly plates 113 and 115; and 123 and 125 coupled on the front and rear surfaces of the amorphous thin plate laminates 11, 21, 31, and 41 and formed in an "I" shape, respectively, differ in lengths only from each other but may be used as yokes or legs of the magnetic circuit.

The amorphous metal cores 1 according to the first embodiment and a second embodiment that will be described later, are configured to have two pairs of "I"-shaped amorphous metal unit cores each having an identical length, as a magnetic circuit forming an endless loop whose overall shape is rectangular.

However, as illustrated in FIG. 9 according to a third embodiment of the present invention, an amorphous metal core may be configured to have four amorphous metal unit cores 10*c*-10*f* formed of equal length to each other and with an "I" shape, respectively, so as to form a magnetic circuit form a square-shaped endless loop.

In addition, as illustrated in FIG. 10 according to a fourth embodiment of the present invention, an amorphous metal core may be configured to have a pair of yokes 10*b* and 20*b* that are formed of long lengths and three legs 30*b*-30*d* that interconnect both end portions and an intermediate portion of the two yokes 10*b* and 20*b* and are formed of short lengths, so as to form a magnetic circuit for three-phase transformers.

Figure 8:
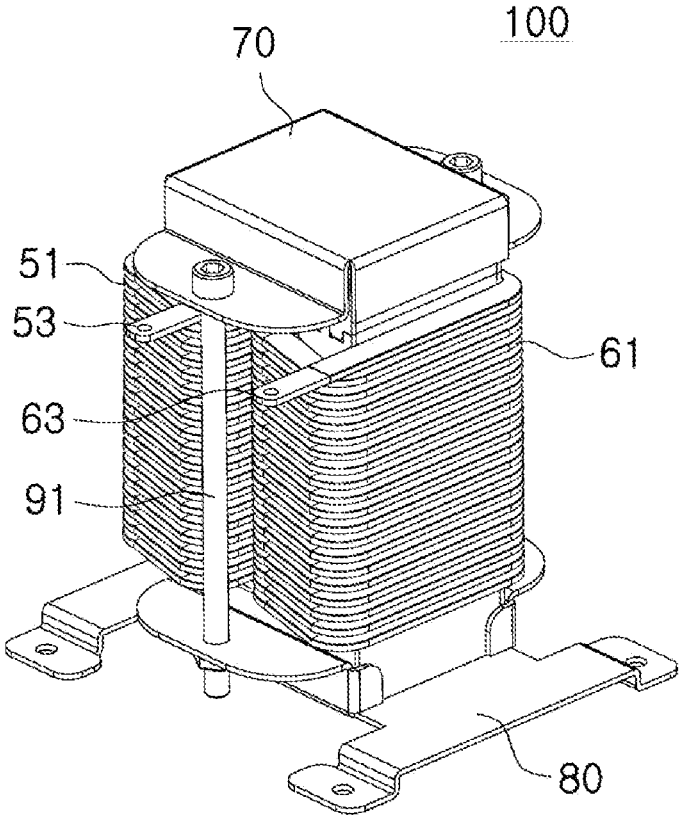

As described above, the amorphous metal core according to the present invention, may be configured with at least four amorphous metal unit cores to form a magnetic circuit. As shown in the first and second embodiments, if bobbins are coupled to the two pairs of the first and second legs 30 and 40; and 30*a* and 40*a* that interconnect the opposed first and second yokes 10 and 20; and 10*a* and 20*a* to each other and coils 51 and 61 are wound, an induction device is prepared as shown in FIG. 8. In this case, it is possible to combine the bobbins on which the coils 51 and 61 have been wound preferably with the two pairs of the first and second legs 30 and 40; and 30*a* and 40*a*.

In this case, the induction device is configured to include a variety of magnetic circuits of a multi-gap type structure, a normal gap-type structure, a oneway gap type structure, or an L-type structure.

The induction device of the multi-gap type structure is configured to have two pairs of spacers that are respectively inserted into two pairs of coupled portions between the first and second yokes 10 and 20; and 10*a* and 20*a* and the first and second legs 30 and 40; and 30*a* and 40*a*, and the induction device of the oneway gap type structure is configured to have one pair of spacers that are respectively inserted into one pair of coupled portions between the first and second yokes 10 and 20; and 10*a* and 20*a* and the first and second legs 30 and 40; and 30*a* and 40*a*.

The induction device of the normal gap type structure, is configured by forming a pair of C-shaped cores that are obtained by combining a pair of legs with a yoke, and then inserting a pair of spacers into coupled portions at which the pair of the C-shaped cores are combined with each other, respectively.

Here, when at least four amorphous metal unit cores are combined with each other, the combined amorphous metal unit cores are fixed by fixing bands made of SUS mounted on the outer circumferences of the amorphous metal unit cores.

Hereinbelow, referring to FIGS. 7 and 8, the induction device 100 using the amorphous metal core 1 according to an embodiment of the present invention will be described.

The induction device 100 includes an amorphous metal core 1, first and second laminated coils 51 and 61, an upper cover 70, a lower cover 80, and a pair of tightening bolts 91 and 95.

The amorphous metal core 1 according to the first embodiment of the present invention is assembled in the form of an endless loop of an approximately rectangular shape, to form a magnetic circuit. First and second yokes 10 and 20 are placed on the top and bottom sides of the amorphous metal core 1, and first and second legs 30 and 40 are disposed between the first and second yokes 10 and 20. In this case, the first and second laminated coils 51 and 61 are wound spirally along the outer circumferences of the first and second legs 30 and 40, respectively. In this case, it is desirable that the first and second laminated coils 51 and 61 are wound in advance on the bobbins (not shown) made of an insulating material, and then are assembled on the first and second legs 30 and 40.

The first and second laminated coils 51 and 61 have terminals 53 and 63 that are connected to the power lines at the end portions, respectively. Also, the cases where the laminated coils 51 and 61 have been used as coils in the embodiments, but it is of course possible to use an insulation coil whose cross-section that is not laminated is circular. The laminated or regular coils 51 and 61 wound around the bobbins form a winding.

The upper and lower covers 70 and 80 are arranged to surround the upper and lower surfaces of the amorphous metal core 1, to thereby secure the amorphous metal core 1 that is obtained by temporarily assembling the first and second yokes 10 and 20 and the first and second legs 30 and 40 through a pair of tightening bolts 91 and 95 and a pair of tightening nuts 93 and 97. In this case, upper flanges 71 and 73 on which through-holes 71*a* and 73*a* are formed are extended on both opposed side surfaces of the upper cover 70, in which the tightening bolts 91 and 95 are inserted into the through-holes 71*a* and 73*a*, and lower flanges 81 and 83 on which through-holes 81*a* and 83*a* are formed are also extended on both opposed side surfaces of the lower cover 80, in which the tightening bolts 91 and 95 are inserted into the through-holes 81*a* and 83*a*, like the upper cover 70.

In addition, two pairs of bases 82*a* and 82*b* that are used to fix the induction device 100 to a main body (not shown) are extended in the forward and backward directions on both sides of the lower cover 80, respectively.

A pair of the tightening bolts 91 and 95 include head portions 91*a* and 95*a* that are fixed on the flanges 71 and 73 of the upper cover 70 at the respective one end thereof, and threaded portions 91*b* and 95*b* with which the tightening nuts 93 and 97 are engaged at the respective other end.

Thus, if the upper cover 70 and the lower cover 80 are coupled on the upper and lower portions of the amorphous metal core 1, and a pair of the tightening bolts 91 and 95 are coupled through the through-holes 71*a*, 73*a*, 81*a*, and 83*a* formed on the upper and lower covers 70 and 80, respectively, the assembly of the induction device 100 shown in FIG. 8 is completed.

As described above, the amorphous metal cores 1 and 1*a* according to the present invention are made of a plurality of rectangular amorphous metal thin plates, to thus facilitate to automate a molding work and ensure durability of a molding device.

In addition, according to the present invention, since a pair of yokes 10 and 20 and a pair of legs 30 and 40 are mutually fixed by using assembly plates 13 and 15; 23 and 25; 33 and 35, and 43 and 45 that are placed separately on the front and rear surfaces of amorphous thin plate laminates 11, 21, 31, and 41, without directly forming coupling protrusions and coupling recesses on the amorphous thin plate laminates 11, 21, 31, and 41 of the pair of the yokes 10 and 20 and the pair of the legs 30 and 40, a minimized mechanical stress may be added to the amorphous thin plate laminates 11, 21, 31, and 41, to thereby provide an effect of suppressing a core loss at a minimum.

As described above, the present invention has been described with respect to particularly preferred embodiments. However, the present invention is not limited to the above embodiments, and it is possible for one who has an ordinary skill in the art to make various modifications and variations, without departing off the spirit of the present invention. Thus, the protective scope of the present invention is not defined within the detailed description thereof but is defined by the claims to be described later and the technical spirit of the present invention.

INDUSTRIAL APPLICABILITY

The present invention relates to amorphous metal cores that can be easily molded and easily automated and easy to be assembled, and is applied to an induction device including transformers, reactors, inductors, etc.

The invention claimed is:

1. An amorphous metal core comprising;

a number of amorphous metal unit cores that include an amorphous thin plate laminate formed by laminating a number of amorphous metal thin plates and a pair of assembly plates respectively laminated on the front and rear surfaces of the amorphous thin plate laminate, and are configured to have an "I" shape, respectively, and form a magnetic circuit having at least one air gap (G); and a coupling unit that separably couples two adjacent amorphous metal unit cores with each other with the at least one air gap formed in-between and with two adjacent assembly plates of the two adjacent amorphous metal unit cores being aligned on a plane, wherein the coupling unit comprises:

at least one coupling protrusion formed on an end of the other two adjacent assembly plates and at least one coupling recess formed on an end of one of the two adjacent assembly plates, the at least one coupling protrusion being inserted into the at least one coupling recess to couple the two adjacent amorphous metal unit cores, wherein a length of the at least one coupling protrusion or a depth of the at least one coupling recess is configured to set a predetermined interval of the air gap.

2. The amorphous metal core according to claim 1, wherein the pair of the assembly plates are made of non-magnetic metal or crystalline magnetic material.

3. The amorphous metal core according to claim 1, wherein the amorphous metal thin plates are formed by slitting and cutting an amorphous metal ribbon.

4. The amorphous metal core according to claim 1, wherein the coupling protrusion protrudes from the amorphous thin plate laminate and the coupling recess partially exposes the amorphous thin plate laminate.

5. The amorphous metal core according to claim 1, wherein the amorphous metal unit cores comprises:

two yokes that are arranged in parallel with each other; and at least two legs that mutually connect the two yokes and that are arranged in parallel to each other.

6. The amorphous metal core according to claim 1, wherein the coupling between the coupling protrusion and the coupling recess is implemented by a snap coupling or a compression coupling.

7. An induction device comprising:

an amorphous metal core including a number of amorphous metal unit cores whose both ends are mutually combined to form a magnetic circuit having at least one air gap and that are formed of an "I" shape, respectively; and at least one coil that is wound on at least one of the amorphous metal unit cores forming the amorphous metal core, wherein each of the amorphous metal unit cores comprises:

an amorphous thin plate laminate formed by laminating a number of rectangular amorphous metal thin plates; and a pair of assembly plates respectively laminated on the front and rear surfaces of the amorphous thin plate laminate, and that include at least one coupling protrusion and at least one coupling recess that are formed on both ends of the amorphous thin plate laminate that are coupled when the amorphous metal unit cores are mutually combined with each other, the at least one coupling protrusion being inserted into the at least one coupling recess to couple two adjacent amorphous metal unit cores, and wherein a length of the at least one coupling protrusion or a depth of the at least one coupling recess is configured to set a predetermined interval of the air gap.

8. The induction device according to claim 7, wherein the amorphous metal unit cores comprises:

two yokes that are arranged in parallel with each other; and at least two legs that mutually connect the two yokes and that are arranged in parallel to each other.

9. The induction device according to claim 7, further comprising an upper cover and a lower cover that surround the two yokes, wherein both sides of the upper cover and the lower cover are interconnected by a pair of tightening bolts, respectively.

* * * * *